US008087656B2

(12) United States Patent
Fujita et al.

(10) Patent No.: US 8,087,656 B2
(45) Date of Patent: Jan. 3, 2012

(54) CASH HANDLING SYSTEM

(75) Inventors: Junji Fujita, Nagoya (JP); Minoru Kadowaki, Toyota (JP); Shinji Shibata, Nagoya (JP); Riichi Kato, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 521 days.

(21) Appl. No.: 12/112,303

(22) Filed: Apr. 30, 2008

(65) Prior Publication Data

US 2008/0290595 A1 Nov. 27, 2008

(30) Foreign Application Priority Data

May 24, 2007 (JP) ..... 2007-138295

(51) Int. Cl.
*B65H 5/22* (2006.01)

(52) U.S. Cl. ..... 271/3.01; 271/279

(58) Field of Classification Search ..... 271/3.01, 271/3.03, 3.04, 3.05, 3.08, 3.12, 177, 178, 271/279, 287, 292, 298; 235/379; 902/12, 902/17

See application file for complete search history.

(56) References Cited

U.S. PATENT DOCUMENTS

| | | | | |
|---|---|---|---|---|
| 5,993,317 | A * | 11/1999 | Majima | 463/29 |
| 6,481,620 | B1 * | 11/2002 | Katou et al. | 235/379 |
| 2002/0092727 | A1 * | 7/2002 | Kato | 194/302 |
| 2009/0085274 | A1 | 4/2009 | Katou et al. | |

FOREIGN PATENT DOCUMENTS

| | | |
|---|---|---|
| EP | 1 008 965 | 6/2000 |
| EP | 1 378 869 | 1/2004 |
| JP | 2006-209603 | 8/2006 |
| KR | 2000-0047974 | 7/2000 |

* cited by examiner

*Primary Examiner* — Stefanos Karmis
*Assistant Examiner* — Thomas Morrison
(74) *Attorney, Agent, or Firm* — Antonelli, Terry, Stout & Kraus, LLP.

(57) ABSTRACT

A cash handling system 10 has an upper unit 100 mounted on a lower unit 200. The upper unit 100 has a cash slot 110, first bill transfer openings 160*a* to 160*c*, and a conveyor line 120. The lower unit 200 has a second bill transfer opening 210, cash cartridges 240, and a conveyor line 220. The conveyor line 120 has multiple conveyance branch paths 120*a* to 120*c* provided corresponding to multiple first bill transfer openings 160*a* to 160*c*. This arrangement enables the position of the cash slot to be readily changeable relative to the cash cartridges.

4 Claims, 12 Drawing Sheets

CASH HANDLING SYSTEM

CROSS REFERENCE TO RELATED APPLICATIONS

The present application claims the priority based on Japanese Patent Application No. 2007-138295 filed on May 24, 2007, the disclosure of which is hereby incorporated herein by reference in its entirety.

BACKGROUND

1. Technical Field

The present invention relates to a cash handling system having an upper unit mounted on a lower unit.

2. Description of the Related Art

The users conventionally use automated teller machines (ATMs) for deposit and withdrawal transactions in financial facilities. The ATM includes a cash handling system, which typically has a cash slot arranged to enable the users' cash deposit and withdrawal, cash cartridges designed to keep bills deposited from and to be withdrawn to the users, and a conveyor line arranged to convey bills between the cash slot and the cash cartridges. One proposed structure of the cash handling system has an upper unit with a cash slot mounted on a lower unit with cash cartridges.

ATMs are installed in financial institutions, convenience stores, and diversity of other locations. There are accordingly various installation circumstances for the ATMs.

One typical installation circumstance of an ATM is outside wall installation to enable the use's access from the outside of a building in financial facility. In the outside wall installation, only a cash slot and a user interface operated for the user's entries of required information are exposed to the outside wall face, while the cash cartridges and the other components are located inside the building. FIG. 13 shows a prior art structure of an ATM in outside wall installation. The ATM includes an operation panel OP operated by a user UR and a cash handling system 10P designed for cash deposit and withdrawal. In this illustrated example, the cash handling system 10P has an upper unit 100P with a cash slot 110P and a lower unit 200P with cash cartridges designed to keep bills therein. The user UR can operate the ATM through an opening provided between outside walls WL and WU. In the outside wall installation of the ATM shown in FIG. 13, the cash slot 110P is located at a position farther from the user UR than the wall surface. The user UR may thus be required to bend over the cash slot 110P for cash deposit and withdrawal. In the outside wall installation of the ATM, the arrangement of the cash slot to be protruded forward from the cash cartridges and to be closer to the user is desirable to allow the user's easy approach and posture for cash deposit and withdrawal. One proposed structure provides a cash slot as a separate unit to locate the cash slot forward from cash cartridges (see, for example, Japanese Patent Laid-Open No. 2006-209603).

The cash slot of the separate unit, however, undesirably complicates the structure of the whole system. The complicated structure increases the manufacturing cost of the cash handling system and causes difficulty in removal of jammed bills.

ATMs are often installed as standalone equipment in convenience stores, drug stores, or diversity of other stores. In the standalone ATMs, the arrangement of the cash slot protruded forward from the cash cartridges to be closer to the user would rather interfere with the user's easy approach and posture for cash deposit and withdrawal.

The various installation circumstances change the position of the cash slot relative to the cash cartridges in the cash handling system.

SUMMARY

An object of the present invention is to provide a technology that enables to change readily the position of a cash slot relative to cash cartridges in a cash handling system.

In one aspect of the present invention, there is provided a cash handling system having an upper unit mounted on a lower unit. The upper unit comprises a cash slot, a first bill transfer structure, and a first conveyor line. The cash slot is arranged to deposit a bill into the cash handling system and to withdraw a bill from the cash handling system. The first bill transfer structure is provided on a bottom face of the upper unit and configured to transfer the bill from and to the lower unit. The first conveyor line is arranged to convey the bill between the cash slot and the first bill transfer structure. The lower unit comprises a second bill transfer structure, a cash cartridge, and a second conveyor line. The second bill transfer structure is provided on a top face of the lower unit and configured to transfer the bill from and to the upper unit. The cash cartridge is configured to keep the bill deposited or to be withdrawn via the cash slot of the upper unit. The second conveyor line is arranged to convey the bill between the second bill transfer structure and the cash cartridge. Wherein one of the first bill transfer structure and the second bill transfer structure is provided in at least one location, and the other of the first bill transfer structure and the second bill transfer structure is provided in at least two locations.

In the conventional design of the upper unit and the lower unit respectively having only one bill transfer structures, a positional change of the upper unit relative to the lower unit misaligns the positions of the bill transfer structures of the upper unit and the lower unit and interferes with transfer of bills between the upper unit and the lower unit. In response to a requirement for a positional change of the upper unit relative to the lower unit, either of the upper unit and the lower unit is to be changed to a different unit having a bill transfer structure provided at a different location.

In the cash handling system according to one aspect of the invention, in order to enable transfer of bills between the upper unit and the lower unit, the position of one arbitrary first bill transfer structure or the position of one arbitrary second bill transfer structure is adjusted to be aligned with the second bill transfer structure or with the first bill transfer structure. Transfer of bills between the upper unit and the lower unit is enabled even in the case of a positional change of the upper unit relative to the lower unit by simply changing the alignment combination of the first bill transfer structure with the second bill transfer structure. This arrangement enables the position of the upper unit to be readily changed relative to the lower unit without requiring replacement with a different unit.

According to another aspect of the present invention, there is provided a cash handling system having an upper unit mounted on a lower unit. The upper unit comprises a cash slot, a first bill transfer structure, and a first conveyor line. The cash slot is arranged to deposit a bill into the cash handling system and to withdraw a bill from the cash handling system. The first bill transfer structure is provided on an opposed face of the upper unit opposite to the lower unit and configured to transfer the bill from and to the lower unit. The first conveyor line is arranged to convey the bill between the cash slot and the first bill transfer structure. The lower unit comprises a second bill transfer structure, a cash cartridge, and a second conveyor line. The second bill transfer structure is provided on an opposed face of the lower unit opposite to the upper unit and configured to transfer the bill from and to the upper unit. The cash cartridge is configured to keep the bill deposited or to be withdrawn via the cash slot of the upper unit. The second conveyor line is arranged to convey the bill between the second bill transfer structure and the cash cartridge. At least one of the upper unit and the lower unit further has a moving mechanism configured to move the first bill transfer structure or the second bill transfer structure along the opposed face of the upper unit or the lower unit.

In the cash handling system according to another aspect of the invention, in order to enable transfer of bills between the upper unit and the lower unit, the position of one of first bill transfer structure and second bill transfer structure is able to be moved. This cash handling system does not require the multiple first bill transfer structures or second bill transfer structures, and desirably simplifies the structure of itself. It is able to reduce the total number of parts and thereby to reduce the manufacturing cost of the cash handling system.

These and other objects, features, aspects, and advantages of the present invention will become more apparent from the following detailed description of the preferred embodiments with the accompanying drawings.

DESCRIPTION OF THE PREFERRED EMBODIMENT

Next, aspects of the present invention will be described in the following order on the basis of embodiment:

A. First Embodiment
B. Second Embodiment
C. Third Embodiment
D. Fourth Embodiment
E. Fifth Embodiment
F. Other Aspects

A. First Embodiment

A1. Structure of Cash Handling System

Figure 1:
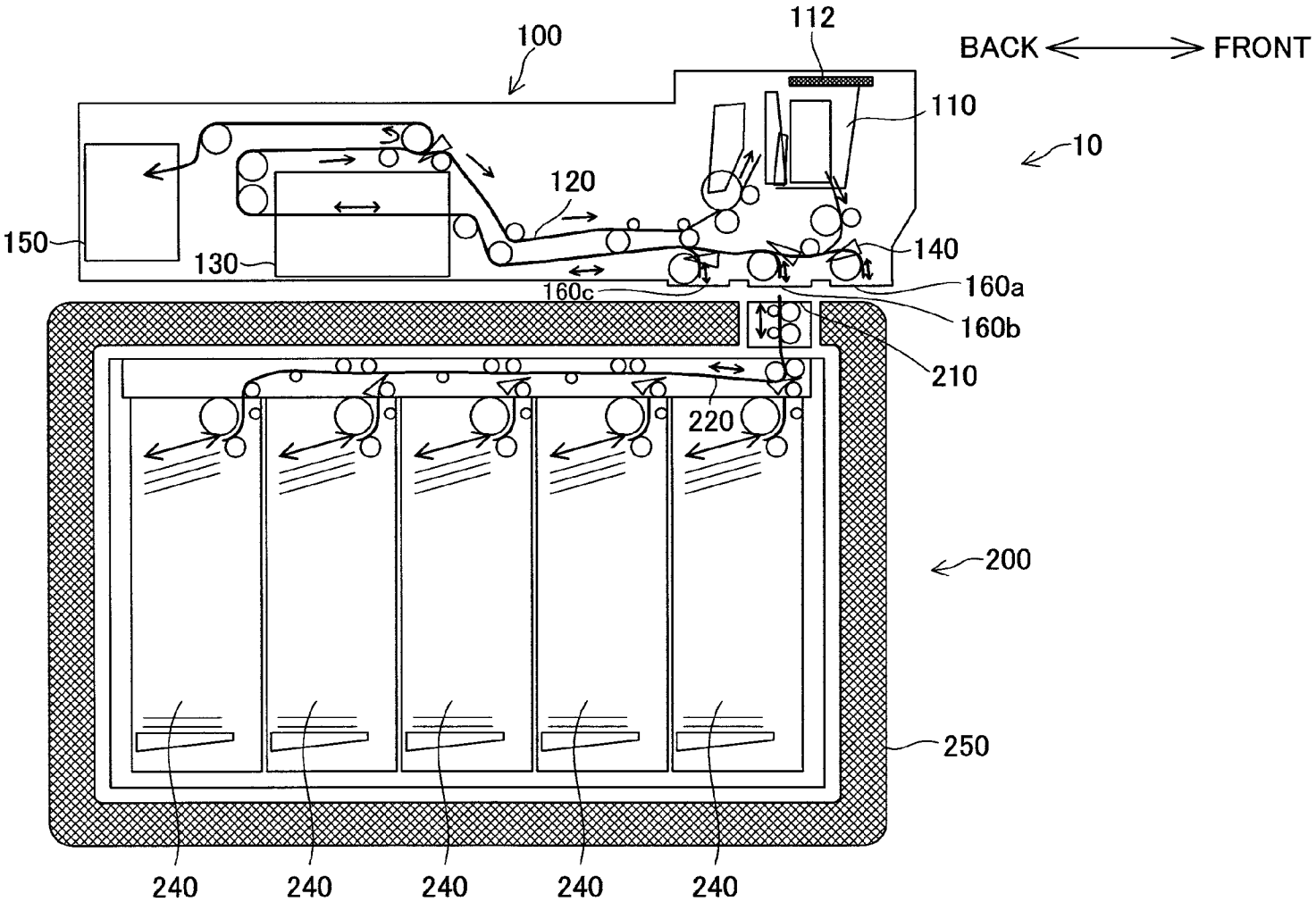
FIG. 1 schematically illustrates the sectional structure of a cash handling system 10 in a first embodiment of the invention.

A cash handling system 10 embodying the invention is built in, for example, an automated teller machine or ATM to keep banknotes or bills deposited by the users and to withdraw the bills kept therein in response to the users' requests. FIG. 1 schematically illustrates the sectional structure of the cash handling system 10 in a first embodiment of the invention.

As shown in FIG. 1, the cash handling system 10 has an upper unit 100 mounted on a lower unit 200. A guide (not shown) is provided in a front-back direction (shown by the arrow in FIG. 1) on the top face of the lower unit 200. The upper unit 100 is slid along the guide in the front-back direction to change the position of the upper unit 100 relative to the lower unit 200 in the front-back direction.

The upper unit 100 includes a cash slot 110, a conveyor line 120, a bill detector 130, a conveyance route selector 140, a reject cartridge 150, and multiple first bill transfer openings 160*a* to 160*c*. The cash slot 110 is provided to enable the user to insert bills into the cash handling system 10 and to take out bills from the cash handling system 10. The cash slot 110 has a function of sending the inserted bills forward one by one. The cash slot 110 has a shutter 112 to open and close the opening of the cash slot 110. The conveyor line 120 interconnects the cash slot 110, the bill detector 130, the reject cartridge 150, and the first bill transfer openings 160*a* to 160*c* and conveys the bills received from the user or to be supplied to the user via the cash slot 110 in the upper unit 100. In the conveyor line 120, the bills are conveyed on conveyor belts spanned between respective conveyance rollers (shown by circles in the drawings).

The bill detector 130 classifies the bills received and to be supplied, checks the authenticity of the bills, and detects significantly damaged bills. The conveyance route selector 140 changes over the conveyance route to deliver the bills to one of the multiple first bill transfer openings 160*a* to 160*c*. The reject cartridge 150 keeps bills identified as unsuitable to be supplied (for example, counterfeit bills and significantly damaged bills) by the bill detector 130. The multiple first bill transfer openings 160*a* to 160*c* are open in a size suitable for bill transfer in a bottom face of the upper unit 100 to enable transfer of bills between the upper unit 100 and the lower unit 200.

The lower unit 200 has a vault 250, a second bill transfer opening 210, a conveyor line 220, and multiple circulation cash cartridges 240 provided to keep the bills received and to be supplied by the respective denominations. The vault 250 is formed as a tough and rigid casing for safety. One second bill transfer opening 210 is open above the vault 250 and has a substantially similar size to those of the multiple first bill transfer openings 160*a* to 160*c*. The conveyor line 220 interconnects the second bill transfer opening 210 and the respective circulation cash cartridges 240 to convey the bills between the second bill transfer opening 210 and the respective circulation cash cartridges 240. In the structure of this embodiment, there are five circulation cash cartridges 240 in the lower unit 200: two for 1000-yen bills, one for 5000-yen bills, and two for 10000-yen bills. Allocation of the denominations to the respective circulation cash cartridges 240 may be set arbitrarily. In the lower unit 200 as in the upper unit 100, bills are conveyed on conveyor belts spanned between respective conveyor rollers (shown by circles in the drawings).

In an application of the cash handling system 10 built in the ATM, the flow of bills in the cash handling system 10 is explained briefly with reference to FIG. 1. A bill handling controller (not shown) provided in the cash handling system 10 controls deposit and withdrawal of bills in response to commands sent from a main controller included in the ATM, while sending information representing the conditions of the cash handling system 10 to the main controller according to the requirements. The bill handling controller controls the operations of drive motors, electromagnetic solenoids, and actuators (not shown) for the respective units (the cash slot 110, the bill detector 130, the conveyor belts, the reject cartridge 150, and the circulation cash cartridges 240) in response to commands sent from the main controller, in order to convey the bills.

For the user's deposit transaction, the user first inserts bills into the cash slot 110. The bills inserted into the cash slot 110 are sent forward from the cash slot 110 and conveyed along the conveyor line 120 to the bill detector 130. The conveyed bills are subjected to the authentication check and damage check by the bill detector 130. The bills identified as unacceptable by the bill detector 130 (for example, significantly damaged bills) are conveyed through the conveyor line 120 to the reject cartridge 150 and are kept therein. The bills identified as acceptable by the bill detector 130, on the other hand, are conveyed through the conveyor line 120 to the first bill transfer opening 160*b*. The bills are then transferred through the second bill transfer opening 210 into the lower unit 200 and are classified by the denominations and are kept in the circulation cash cartridges 240 by the respective denominations.

For the user's withdrawal transaction, required numbers of respective denomination bills corresponding to the user's specified amount of money are sent from the respective circulation cash cartridges 240 and are conveyed through the conveyor line 220 to the second bill transfer opening 210. The respective denomination bills are then transferred to the upper unit 100 via the first bill transfer opening 160*b*. The bills are further conveyed through the conveyor line 120 to the bill detector 130 and are subjected to the authentication check and damage check. As in the case of the deposit transaction, the bills identified as non-withdrawable by the bill detector 130 (for example, significantly damaged bills) are conveyed through the conveyor line 120 to the reject cartridge 150 and are kept therein. The bills identified as withdrawable by the bill detector 130, on the other hand, are conveyed through the conveyor line 120 to the cash slot 110 and are supplied to the user.

Figure 2:
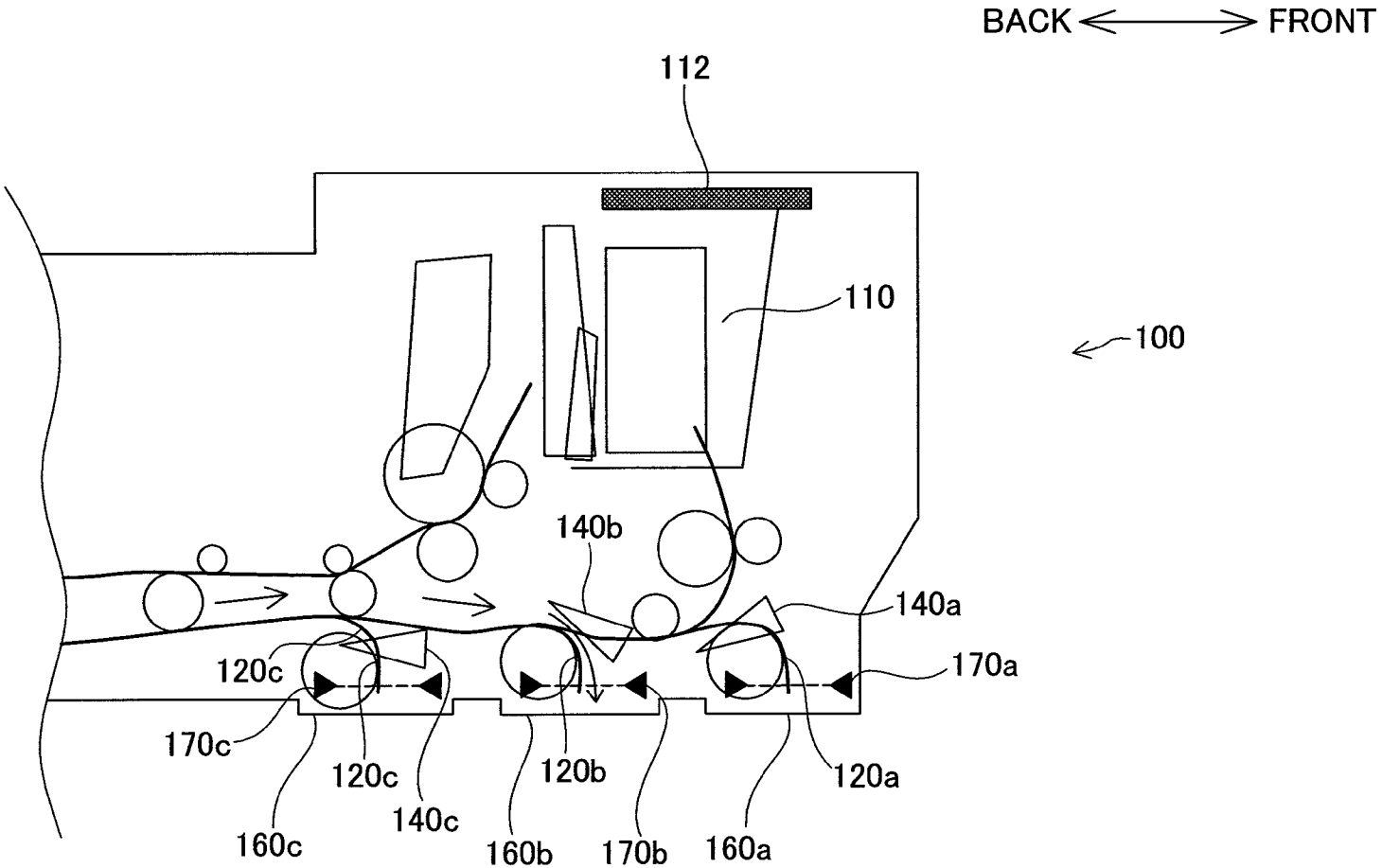
FIG. 2 is a partial enlarged view showing part of the cash handling system 10.

FIG. 2 is a partial enlarged view showing part of the cash handling system 10. The vicinity of the multiple first bill transfer openings 160*a* to 160*c* included in the upper unit 100 is shown in closeup in FIG. 2. The following gives detailed description of the conveyor line 120, the conveyance route selector 140, and the multiple first bill transfer openings 160*a* to 160*c* included in the upper unit 100 with reference to FIG. 2.

The conveyor line 120 has three conveyance branch paths 120*a*, 120*b*, and 120*c* corresponding to the three first bill transfer openings 160*a*, 160*b*, and 160*c* to convey the bills to the respective first bill transfer openings 160*a*, 160*b*, and 160*c*. Conveyance route switches 140*a*, 140*b*, and 140*c* are provided respectively in the neighborhood of the conveyance branch paths 120*a*, 120*b*, and 120*c*. The respective conveyance route switches 140*a*, 140*b*, and 140*c* are operated to change their angles and thereby switch over the conveyance route of the bills. For example, in the state of FIG. 2, the bills identified as acceptable by the bill detector 130 are conveyed to the first bill transfer opening 160*b*. Setting the angles of the conveyance route switches 140*b* and 140*c* to the illustrated angles causes the bills to be guided by the conveyor belt and the conveyance route switch 140*b* and to be conveyed through the conveyance branch path 120*b* to the first bill transfer opening 160*b* as shown by the arrow in FIG. 2.

Optical sensors 170*a* to 170*c* are provided at the respective first bill transfer openings 160*a* to 160*c*. The bills shield the light emitted from one of the optical sensors 170*a* to 170*c*. This identifies which of the multiple first bill transfer openings 160*a* to 160*c* the bills pass through.

In the application of the cash handling system 10 built in the ATM, the user naturally stands on a side close to the cash slot 110 (on the right side in the illustration of FIG. 1). In this embodiment, the right side and the left side in the illustration of FIG. 1 respectively represent a front side and a back side of the cash handling system 10. The cash slot 110 of the cash handling system 10 is located on the front side, whereas the reject cartridge 150 is located on the back side. Namely one face of the cash handling system 10 closer to the user is a front face, and the opposite face of the cash handling system 10 further from the user is a back face. The upper unit 100 has the three first bill transfer openings 160*a* to 160*c* arranged in its front side at equal intervals along the front-back direction. The lower unit 200 has only one second bill transfer opening 210 arranged in its front side.

In the cash handling system 10 of FIG. 1, the upper unit 100 is mounted on the lower unit 200 in such a manner that the first bill transfer opening 160*b* is aligned with the second bill transfer opening 210. Namely the position of the upper unit 100 mounted on the lower unit 200 is adjusted relative to the lower unit 200 to make the front face of the upper unit 100 approximately aligned with the front face of the lower unit 200.

Figure 3:
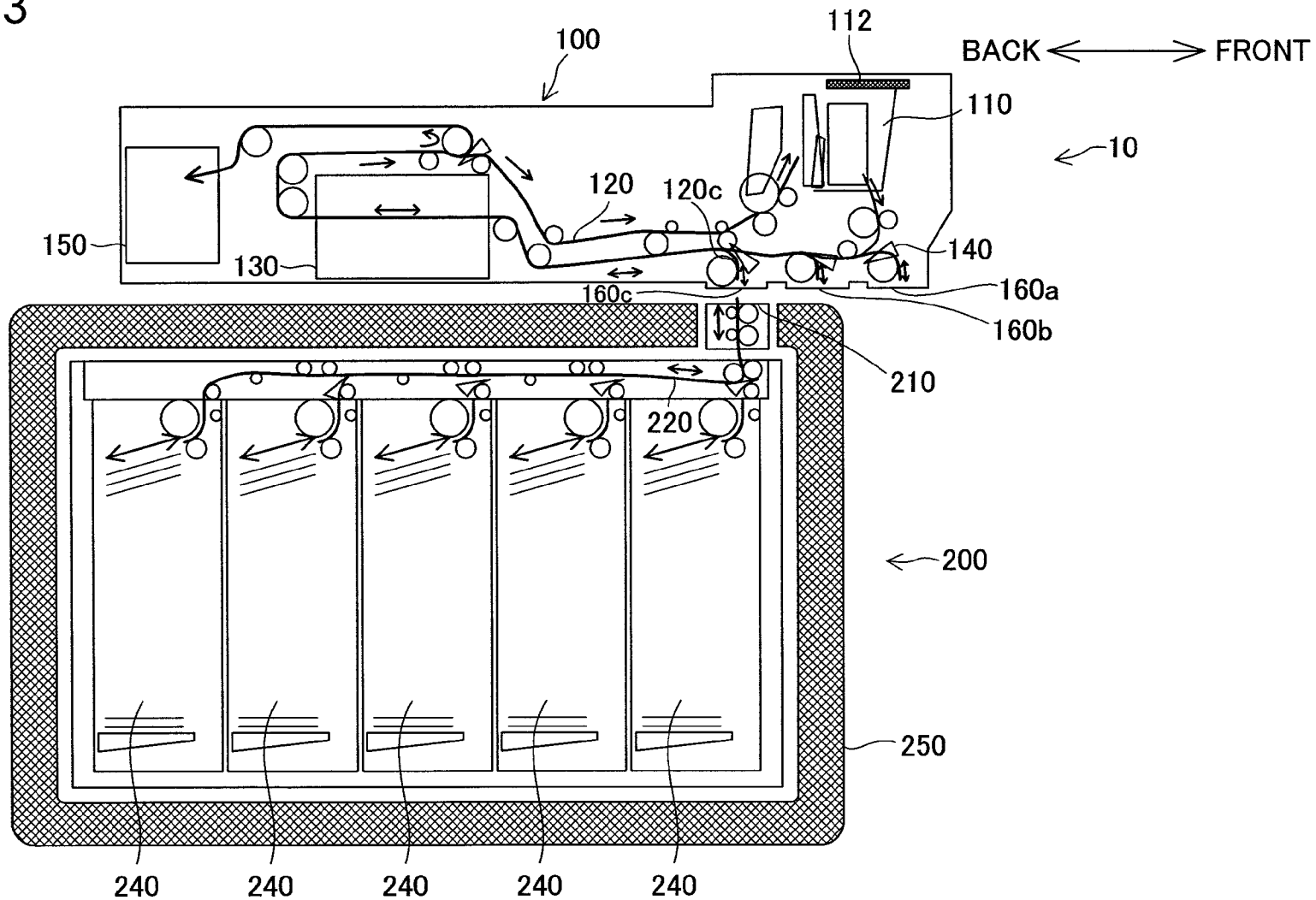
FIG. 3 shows the position adjustment of an upper unit 100 relative to a lower unit 200 where a first bill transfer opening 160*c* is aligned with a second bill transfer opening 210.

In the cash handling system 10 of this embodiment, the upper unit 100 may be mounted on the lower unit 200 to make either the first bill transfer opening 160*a* or the first bill transfer opening 160*c* aligned with the second bill transfer opening 210. FIG. 3 shows the position adjustment of the upper unit 100 relative to the lower unit 200 where the first bill transfer opening 160*c* is aligned with the second bill transfer opening 210. In this state, the front face of the upper unit 100 is protruded forward from the front face of the lower unit 200. Setting the angles of the conveyance route switches 140*a* to 140*c* to the illustrated angles in the conveyance route selector 140 causes the bills to be guided by the conveyor belt and the conveyance route selector 140 and to be conveyed through the conveyance branch path 120*c* to the first bill transfer opening 160*c* as shown by the arrow in FIG. 3. Such position adjustment is suitable, for example, for the installation circumstance of an ATM in the outside wall to allow the user's easy approach and posture for cash deposit and withdrawal.

Figure 4:
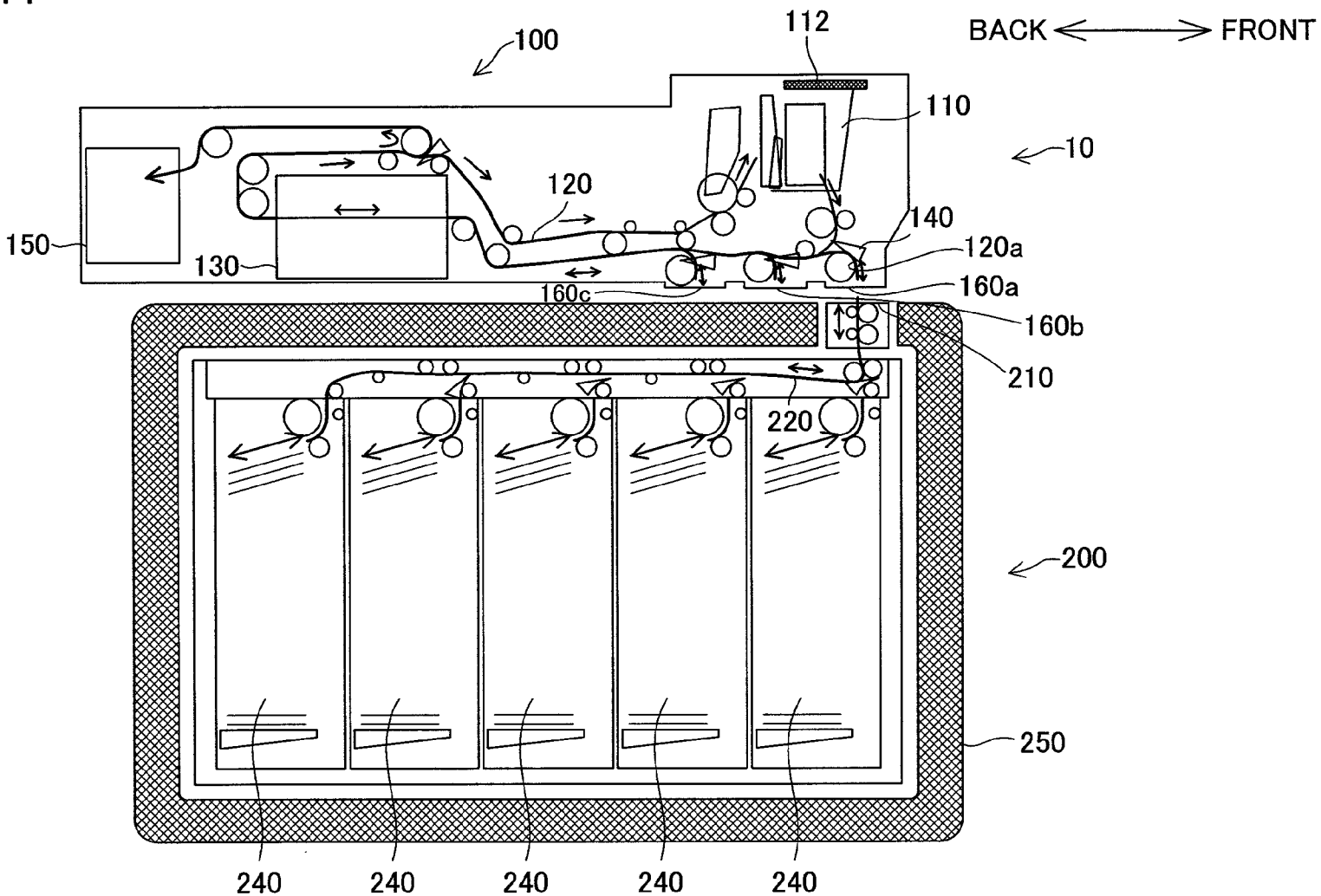
FIG. 4 shows the position adjustment of the upper unit 100 relative to the lower unit 200 where a first bill transfer opening 160*a* is aligned with the second bill transfer opening 210.

FIG. 4 shows the position adjustment of the upper unit 100 relative to the lower unit 200 where the first bill transfer opening 160*a* is aligned with the second bill transfer opening 210. In this state, the front face of the upper unit 100 is retarded behind the front face of the lower unit 200. Setting the angles of the conveyance route switches 140*a* to 140*c* to the illustrated angles in the conveyance route selector 140 causes the bills to be guided by the conveyor belt and the conveyance route selector 140 and to be conveyed through the conveyance branch path 120*a* to the first bill transfer opening 160*a* as shown by the arrow in FIG. 4.

In the illustrations of FIGS. 1, 3, and 4, for the convenience of explanation, there is a space between one of the first bill transfer openings 160 and the second bill transfer opening 210. In the actual state, however, the first bill transfer opening 160 and the second bill transfer opening 210 are engaged with each other by some fitting mechanism, although such engagement is neither essential nor restrictive. In the structure of this embodiment, the upper unit 100 is slid along the guide formed on the top face of the lower unit 200 to change its position relative to the lower unit 200. This structure is, however, not essential, but the upper unit 100 may simply be mounted on the lower unit 200. In this case, one of the first bill transfer openings 160 is simply aligned with and communicates with the second bill transfer opening 210.

The first bill transfer openings 160*a* to 160*c* and the conveyance branch paths 120*a* to 120*c* of this embodiment are equivalent to the first bill transfer structure of the invention. The second bill transfer opening 210 and the conveyor line 220 are equivalent to the second bill transfer structure of the invention. The conveyance route switches 140*a* to 140*c* correspond to the selector of the invention, and the optical sensors 170*a* to 170*c* correspond to the bill sensor of the invention.

A2. Structure of ATM

Figure 5:
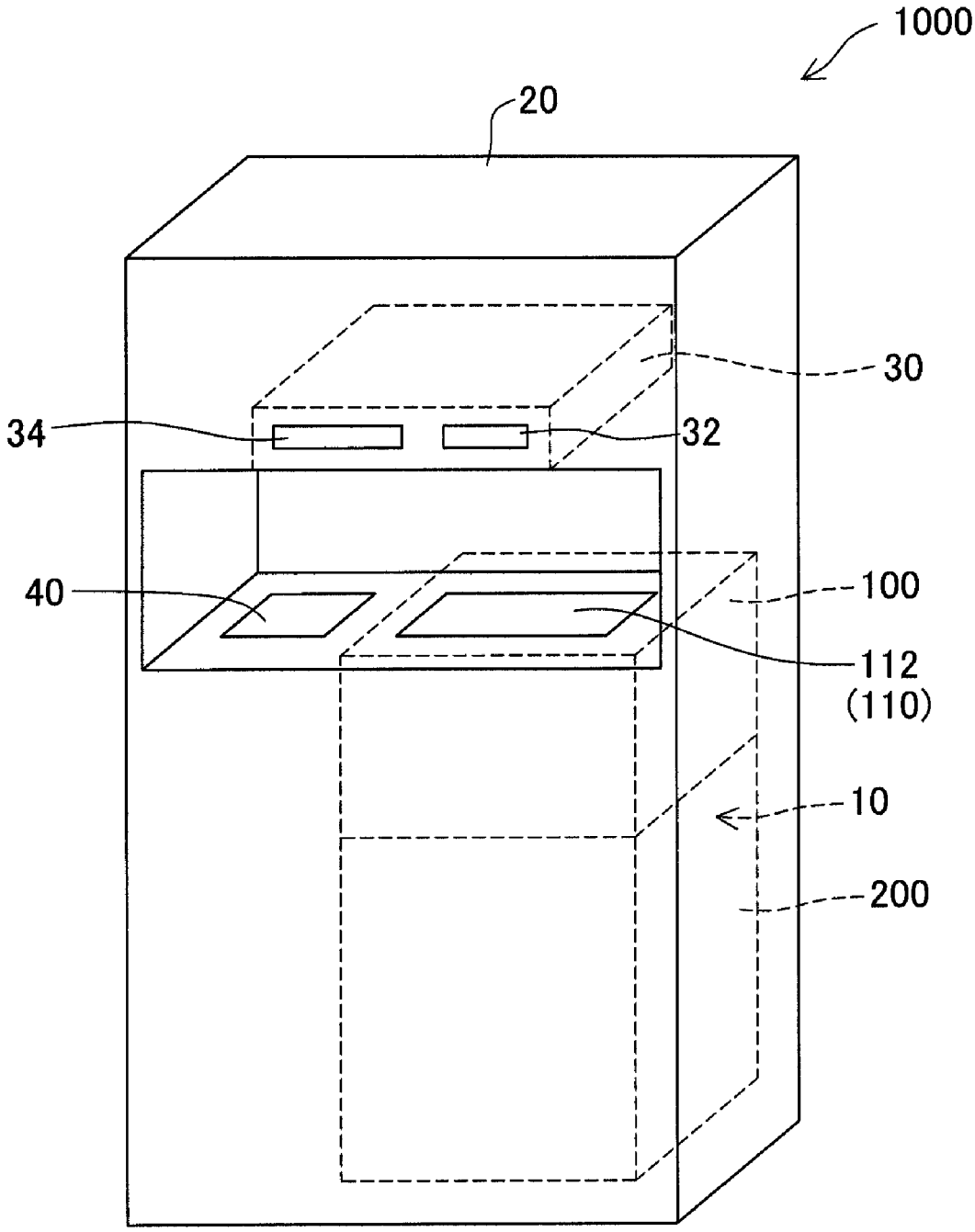
FIG. 5 schematically illustrates the structure of an ATM 1000.

FIG. 5 schematically illustrates the structure of an ATM 1000. As one typical application of the cash handling system 10, the ATM 1000 of FIG. 5 is a stand-alone type and has the built-in cash handling system 10. The ATM 1000 includes a housing 20, the cash handling system 10, a card/passbook processor 30, a user interface 40, and a main controller (not shown). The card/passbook processor 30 has a card slot 32 and a passbook slot 34. The user's transaction details are displayed on the user interface 40. In the built-in cash handling system 10 of the ATM 1000, the position of the upper unit 100 is adjusted relative to the lower unit 200 to make the front face of the upper unit 100 approximately aligned with the front face of the lower unit 200. As illustrated, the shutter 112 of the cash slot 110 in the cash handling system 10 is exposed to the surface of the housing 20.

The card/passbook processor 30, the cash handling system 10, and the user interface 40 are connected to the main controller by means of, for example, USB connection lines to be controlled by the main controller. For example, in the case of the user's withdrawal transaction from the ATM 1000, the main controller controls the card/passbook processor 30 to read required pieces of information from a card or a passbook for the user identification and authentication. The main controller also controls the cash handling system 10 based on the user's entered pieces of information through the user interface 40 to supply the user a required amount of bills. The shutter 112 is automatically opened and closed in response to commands of the main controller.

The main controller may additionally connected with an external interface, a human teller interface system, and an external storage device (not shown) to control transmission of various pieces of information required for maintenance of the ATM 1000.

A3. Effects of First Embodiment

In the structure of the cash handling system 10 of the first embodiment described above, the position of the upper unit 100 mounted on the lower unit 200 is changeable relative to the lower unit 200 by adjusting the position of one of the multiple first bill transfer openings 160*a* to 160*c* to be aligned with the second bill transfer opening 210. This structure enables the position of the upper unit 100 relative to the lower unit 200 to be readily changed according to the installation circumstance of an ATM with the built-in cash handling system 10.

The conveyance branch paths 120*a* to 120*c* are provided corresponding to the respective first bill transfer openings 160*a* to 160*c*. The combination of one of the conveyance branch paths 120*a* to 120*c* with the conveyor line 220 enables transfer of bills between the upper unit 100 and the lower unit 200. The conveyance branch paths 120*a* to 120*c* are respectively equipped with the conveyance route switches 140*a* to 140*c*. The angles of the conveyance route switches 140*a* to 140*c* are adjusted to guide the bills through a selected conveyance branch path among the conveyance branch paths 120*a* to 120*c* to the conveyor line 220. Such angle adjustment lowers the potential for the bills to be conveyed through the remaining conveyance branch paths (for example, the conveyance branch paths 120*a* and 120*c* in FIG. 2) other than the selected conveyance branch path (for example, the conveyance branch path 120*b* in FIG. 2) for conveyance of the bills to the conveyor line 220.

As explained above, the optical sensors 170*a* to 170*c* are provided corresponding to the respective first bill transfer openings 160*a* to 160*c* to check for the successful transfer of the bills through the selected conveyance branch path. This arrangement enables detection of a wrong bill conveyance in the event of transfer of the bills through any of the remaining conveyance branch paths other than the selected conveyance branch path. In response to detection of the wrong bill conveyance, the cash handling system 10 may be stopped and may give a display informing the user of the wrong bill conveyance on the user interface 40 of the ATM 1000.

B. Second Embodiment

Figure 6:
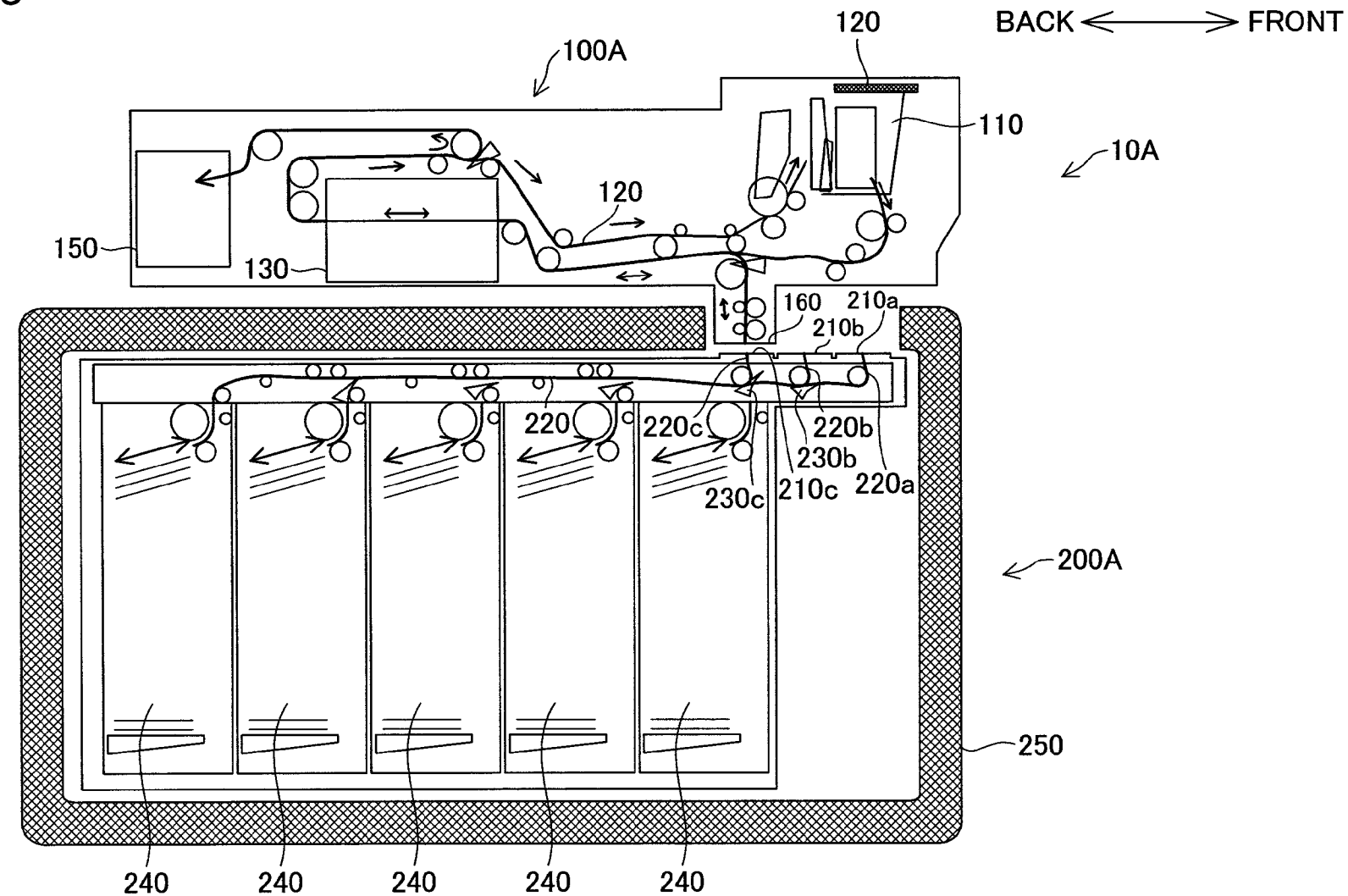
FIG. 6 schematically illustrates the sectional structure of another cash handling system 10A in a second embodiment of the invention.

FIG. 6 schematically illustrates the sectional structure of another cash handling system 10A in a second embodiment of the invention. As in the cash handling system 10 of the first embodiment shown in FIG. 1, the cash handling system 10A of the second embodiment has an upper unit 100A mounted on a lower unit 200A. The cash handling system 10A of the second embodiment has the different arrangement of the first bill transfer opening 160, the conveyor line 120, the second bill transfer opening 210, and the conveyor line 220 from the corresponding arrangement in the cash handling system 10 of the first embodiment.

In the cash handling system 10 of the first embodiment, the upper unit 100 has the three first bill transfer openings 160*a* to 160*c* and the three corresponding branch paths of the conveyor line 120 for conveyance of bills. In the cash handling system 10A of the second embodiment, on the other hand, the lower unit 200A has three second bill transfer openings 210*a* to 210*c* and three corresponding branch paths 220*a* to 220*c* of the conveyance line 220 for conveyance of bills. The upper unit 100A has only one first bill transfer opening 160 and no branch path of the conveyor line 120.

Conveyance route switches 230*b* and 230*c* are respectively provided in the neighborhood of the conveyance branch paths 220*b* and 220*c*. The angles of the conveyance route switches

230*b* and 230*c* are changed to switch over the conveyance route of bills. For example, the conveyance route switch 230*c* is set to the angle illustrated in FIG. 6 to convey the bills sent from the circulation cash cartridges 240 to the upper unit 100A. Such setting causes the bills to be guided by the conveyor belt and the conveyance route switch 230*c* and to be conveyed through the conveyance branch path 220*c* to the second bill transfer opening 210*c*. The bills are then transferred via the first bill transfer opening 160 and conveyed through the conveyor line 120 in the upper unit 100A.

In the state of FIG. 6, the upper unit 100A is mounted on the lower unit 200A such that the first bill transfer opening 160 is aligned with the second bill transfer opening 210*c*. Namely the position of the upper unit 100A mounted on the lower unit 200A is adjusted relative to the lower unit 200A to make the front face of the upper unit 100A approximately aligned with the front face of the lower unit 200A.

Figure 7:
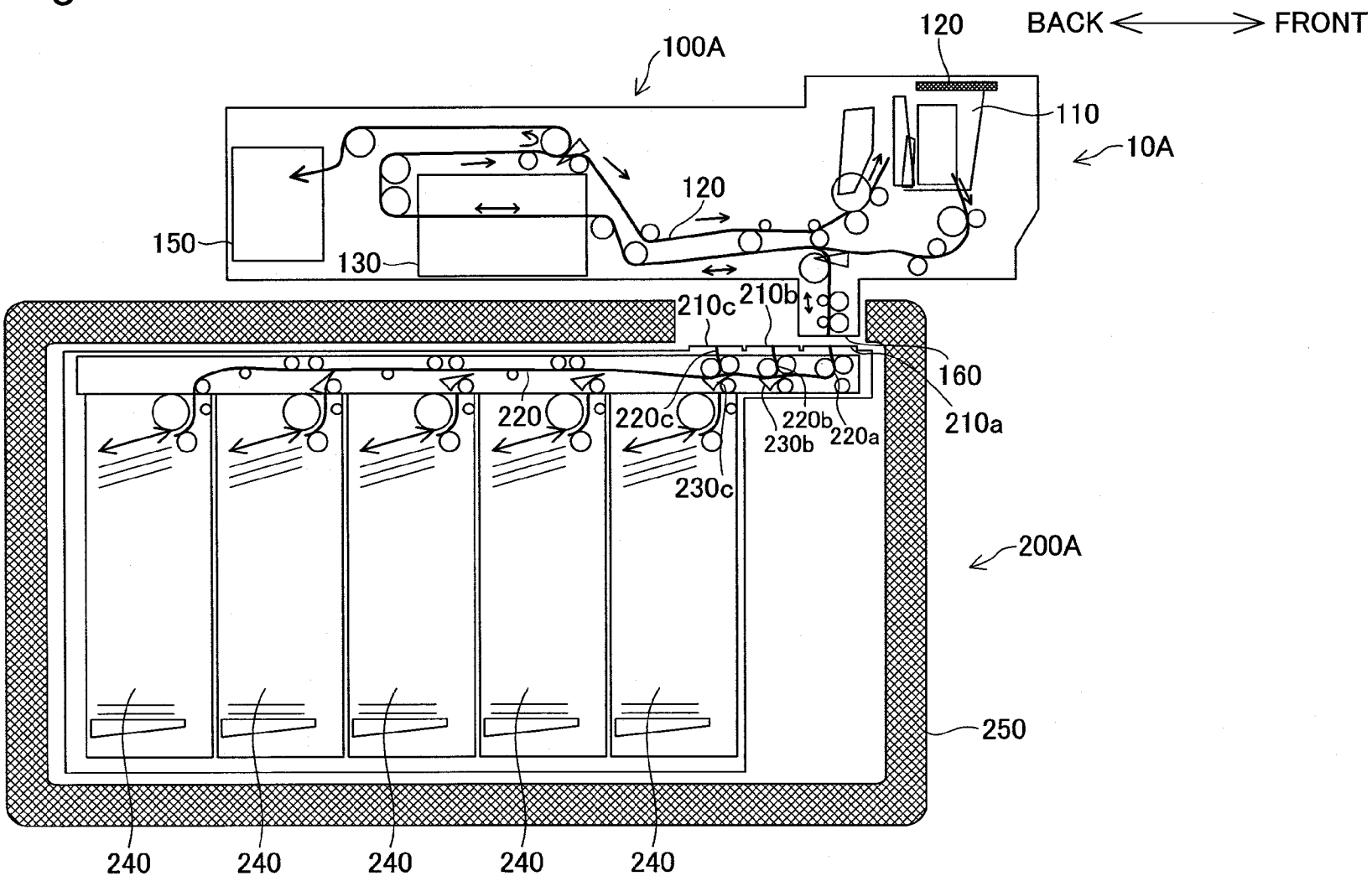
FIG. 7 shows the position adjustment of an upper unit 100A relative to a lower unit 200A where a first bill transfer opening 160 is aligned with a second bill transfer opening 210*a;*

FIG. 7 shows the position adjustment of the upper unit 100A relative to the lower unit 200A where the first bill transfer opening 160 is aligned with the second bill transfer opening 210*a*. In this state, the front face of the upper unit 100A is protruded forward from the front face of the lower unit 200A. Such position adjustment is suitable, for example, for the installation circumstance of an ATM in the outside wall to allow the user's easy approach and posture for cash deposit and withdrawal.

In the case of transfer of bills sent from the circulation cash cartridges 240 to the upper unit 100A, the conveyance route switches 230*b* and 230*c* are set at the illustrated angles. Such angle adjustment of the conveyance route switches 230*b* and 230*c* prevents the bills from being conveyed through the conveyance branch path 220*b* or the conveyance branch path 220*c* but causes the bills to be conveyed through the conveyance branch path 220*a* to the second bill transfer opening 210*a*. The bills are then transferred via the first bill transfer opening 160 and conveyed through the conveyor line 120 in the upper unit 100A.

In the structure of the cash handling system 10A of the second embodiment described above, the position of the upper unit 100A mounted on the lower unit 200A is changeable relative to the lower unit 200A by adjusting the position of the first bill transfer opening 160 to be aligned with one of the multiple second bill transfer openings 210*a* to 210*c*. This structure of the second embodiment accordingly has the same advantages and effects as those of the first embodiment explained above.

C. Third Embodiment

Figure 8:
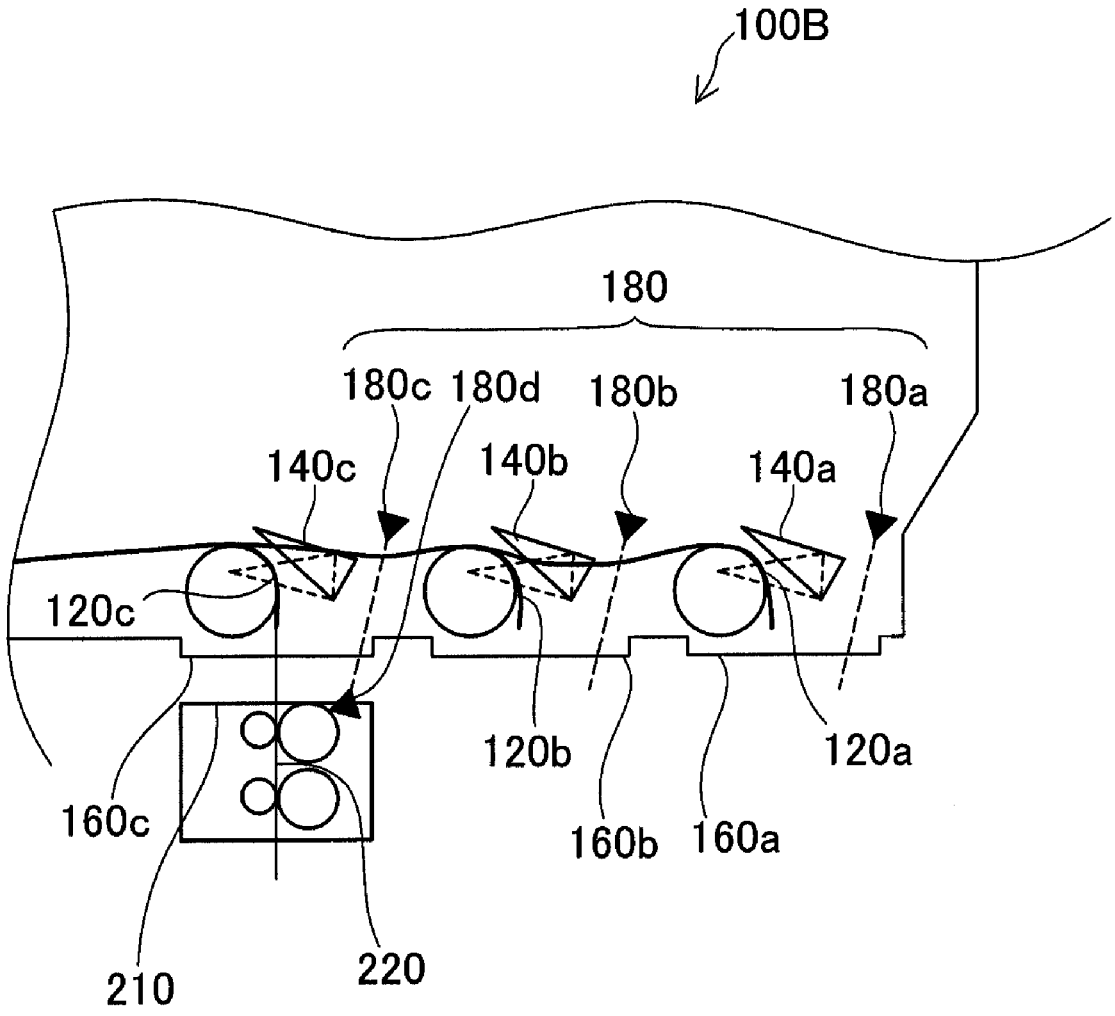
FIG. 8 is a partial enlarged view showing part of a cash handling system 10B in a third embodiment of the invention.

FIG. 8 is a partial enlarged view showing part of a cash handling system 10B in a third embodiment of the invention. The vicinity of multiple first bill transfer openings 160*a* to 160*c* included in an upper unit 100B and a second bill transfer opening 210 in a lower unit is shown in closeup in FIG. 8. The cash handling system 10B has a unit position detector 180 to detect the position of the upper unit 100B relative to the lower unit, in addition to the structure of the cash handling system 10 of the first embodiment shown in FIG. 1.

The unit position detector 180 is constructed as an optical sensor and has light emitting elements 180*a* to 180*c* and a light receiving element 180*d*. The light emitting elements 180*a* to 180*c* are provided in the upper unit 100B to emit light. The light emitted from each of the light emitting elements 180*a* to 180*c* is transmitted through corresponding one of the first bill transfer openings 160*a* to 160*c*. The light receiving element 180*d* is provided in the vicinity of the second bill transfer opening 210 in the lower unit.

In the state of FIG. 8, the upper unit 100B is mounted on the lower unit such that the first bill transfer opening 160*c* is aligned with the second bill transfer opening 210. In this state, the light emitted from the light emitting element 180*c* is expected to be received by the light receiving element 180*d*. The successful light receiving ensures that the first bill transfer opening 160*c* is aligned with the second bill transfer opening 210. This arrangement effectively reduces potential troubles, such as failed transfer of bills between the upper unit 100B and the lower unit and jamming of a bill due to the positional misalignment of the first bill transfer opening 160*c* with the second bill transfer opening 210.

D. Fourth Embodiment

Figure 9:
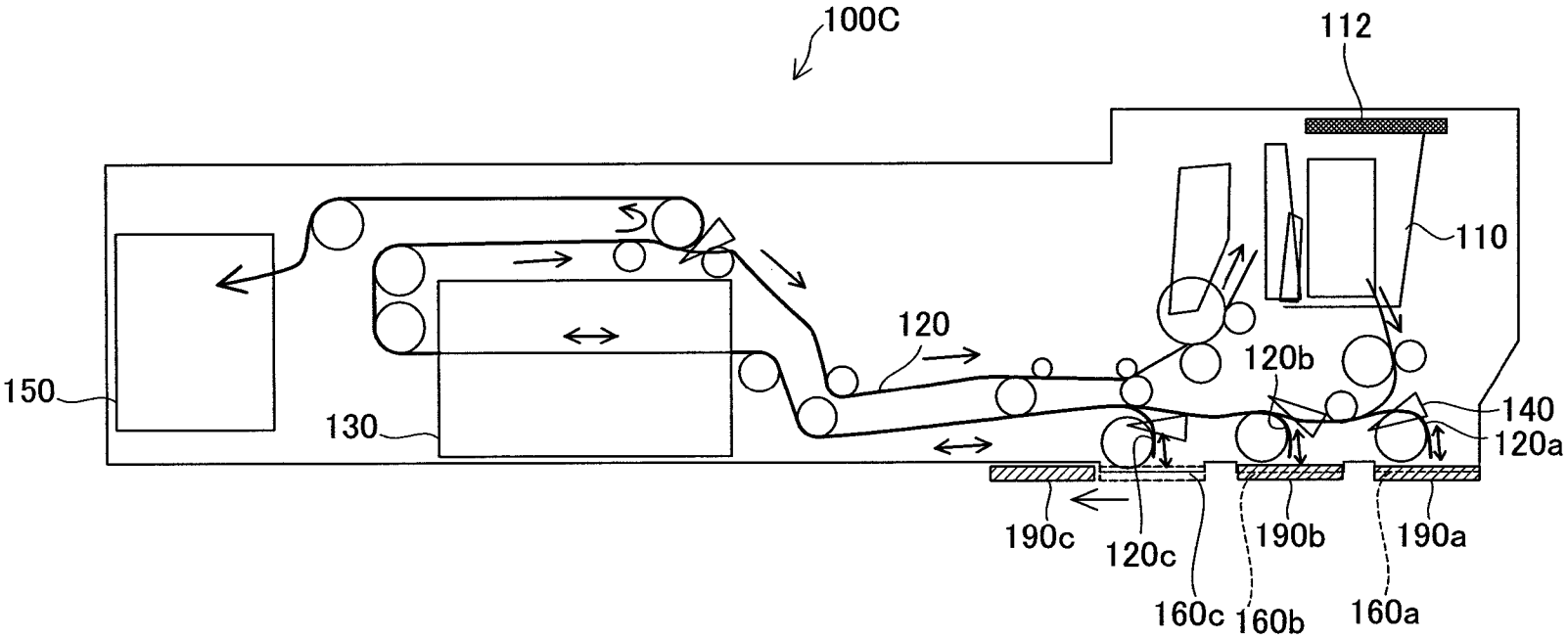
FIG. 9 schematically illustrates the sectional structure of an upper unit 100C included in a cash handling system 10C in a fourth embodiment of the invention.

FIG. 9 schematically illustrates the sectional structure of an upper unit 100C included in a cash handling system 10C in a fourth embodiment of the invention. In the cash handling system 10C, the upper unit 100C has bill transfer interference elements 190*a* to 190*c*, in addition to the structure of the cash handling system 10 of the first embodiment shown in FIG. 1. The bill transfer interference elements 190*a* to 190*c* are provided corresponding to the respective first bill transfer openings 160*a* to 160*c* and are formed as covers to block the corresponding first bill transfer openings 160*a* to 160*c*.

For example, while the bills are conveyed through the conveyance branch path 120*c* to the lower unit as shown in FIG. 1, the first bill transfer opening 160*b* corresponding to the conveyance branch path 120*b* and the first bill transfer opening 160*a* corresponding to the conveyance branch path 120*a* are respectively blocked by the bill transfer interference element 190*b* and the bill transfer interference element 190*a* as shown in FIG. 9. The bill transfer interference element 190*c* is slid to a rest position not to block the first bill transfer opening 160*c*. Even in the event of unexpected transfer of the bills through the conveyance branch path 120*b* or the conveyance branch path 120*a*, this arrangement effectively prevents the bills to be discharged out of the cash handling system 10C via the first bill transfer opening 160*b* or the first bill transfer opening 160*a*.

The bill transfer interference elements 190*a* to 190*c* are provided as movable elements in the structure of the embodiment, but may alternatively be given as unmovable fixed elements. The latter case may use, for example, two bill transfer interference elements 190*a* and 190*b*. When the bills are conveyed through the conveyance branch path 120*c* as shown in FIG. 1, the two bill transfer interference elements 190*a* and 190*b* are fastened to respectively block the remaining two first bill transfer openings 160*a* and 160*b*. When the bills are conveyed through the conveyance branch path 120*b*, the two bill transfer interference elements 190*a* and 190*b* are fastened to respectively block the remaining two first bill transfer openings 160*a* and 160*c*. Blockage of the first bill transfer openings corresponding to the non-selected conveyance branch paths also effectively prevents the bills from being unexpectedly discharged out of the cash handling system 10C.

E. Fifth Embodiment

Figure 10A:
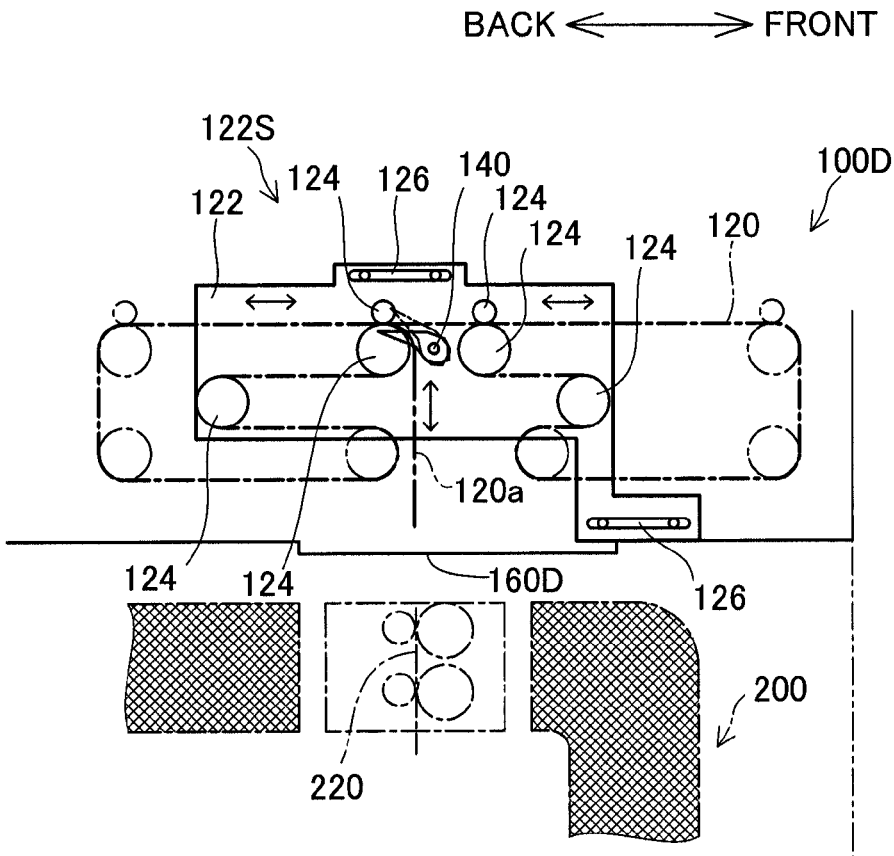
FIG. 10 is a partial enlarged view showing part of a cash handling system 10D in a fifth embodiment of the invention.
Figure 10B:
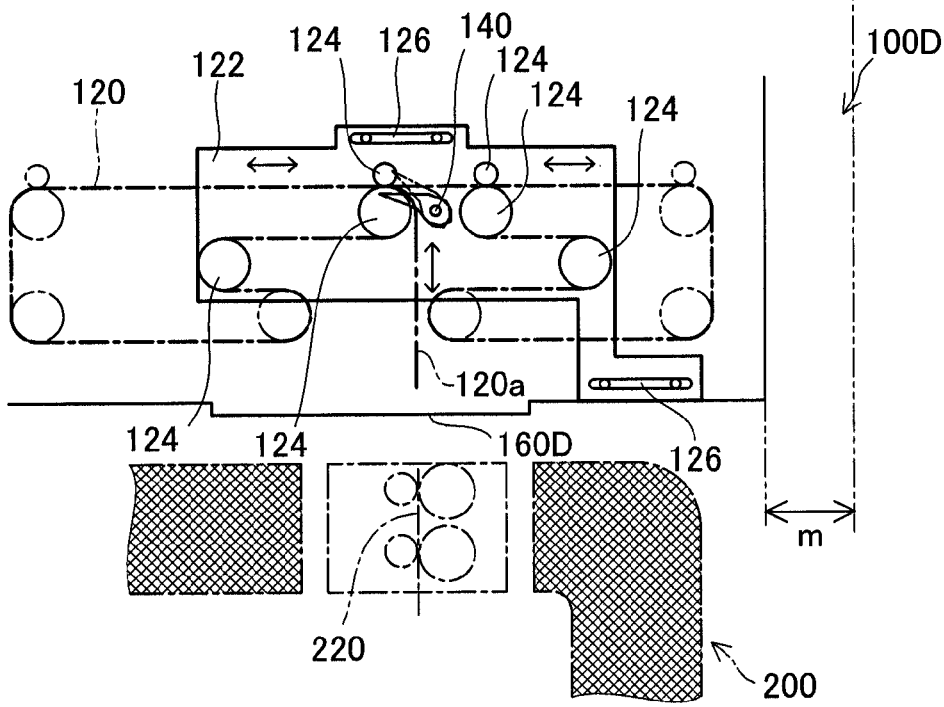

FIG. 10 is a partial enlarged view showing part of a cash handling system 10D in a fifth embodiment of the invention. The vicinity of a first bill transfer opening 160D included in an upper unit 100D is shown in closeup in FIG. 10. As in the cash handling system 10 of the first embodiment shown in FIG. 1, the cash handling system 10D of the fifth embodiment has the upper unit 100D mounted on a lower unit 200. The lower unit 200 of the fifth embodiment is identical with the lower unit 200 of the first embodiment. The upper unit 100D of the fifth embodiment has the different arrangement of the first bill transfer opening 160D, the conveyor line 120, and the conveyance route selector 140 from the corresponding arrangement in the upper unit 100 of the first embodiment.

The upper unit 100D has one first bill transfer opening 160D open to its bottom face. The first bill transfer opening 160D is significantly longer in the front-back direction of the upper unit 100D, compared with each of the first bill transfer openings 160 formed in the upper unit 100 of the first embodiment. The conveyor line 120 has one conveyance branch path 120*a* to enable conveyance of bills to the first bill transfer opening 160D. In the upper unit 100D of this embodiment, the conveyance branch path 120*a* is movable in the front-back direction along and in the range of the first bill transfer opening 160D.

A conveyance path moving mechanism 122S is provided to move the conveyance branch path 120*a* as explained below with reference to FIGS. 10(*a*) and 10(*b*). The position of the conveyance branch path 120*a* in FIG. 10(*b*) is moved from the position in FIG. 10(*a*). The conveyance path moving mechanism 122S is shown by the solid lines in FIG. 10. The conveyance path moving mechanism 122S of this embodiment is equivalent to the moving mechanism of the invention.

The conveyance path moving mechanism 122S includes two plates 122, multiple conveyor rollers 124, and a conveyance route selector 140. The two plates 122 are arranged to be parallel and face each other. The multiple conveyor rollers 124 are located between the two plates 122. The conveyance route selector 140 is attached to the plates 122 in a pivotally movable manner to change the angle.

The conveyance path moving mechanism 122S is set inside the upper unit 100D in such a manner that the two plates 122 are respectively fastened to the opposed inner side faces of the upper unit 100D (left and right side faces seen from the user). The plate 122 fastened to the right side face (seen from the user) is shown in FIG. 10. Namely the multiple conveyor rollers 124 are extended in parallel to the surface of paper used for illustration. Slots 126 are formed in the respective plates 122 and the corresponding side faces of the upper unit 100D. The plates 122 are fastened to the respective side faces of the upper unit 100D with bolts and nuts set in the slots 126.

A conveyor belt is set to interconnect the respective conveyor roller 124 in the conveyance path moving mechanism 122S built in the upper unit 100D. Adjusting the angle of the conveyance route selector 140 completes the conveyor line 120 and the conveyance branch path 120*a* shown by the one-dot chain lines in FIG. 10.

The position of the conveyance path moving mechanism 122S may be shifted in a certain range in the front-back direction in the upper unit 100D by displacing the slots 126 of the plates 122 relative to the slots 126 of the respective side faces of the upper unit 100D and fastening the plates 122 to the side faces with bolts and nuts. This shifts the position of the conveyance branch path 120*a* in the front-back direction in the upper unit 100D. The position of the upper unit 100D relative to the lower unit 200 is thus changeable by making the position of the conveyor line 220 in the lower unit 200 aligned with the position of the conveyance branch path 120*a*.

In the illustrations of FIGS. 10(*a*) and 10(*b*), the position of the front face of the lower unit 200 is fixed. Comparison between FIGS. 10(*a*) and 10(*b*) shows that the front face of the upper unit 100D shown in FIG. 10(*a*) is protruded forward by a distance 'm' from the front face of the upper unit 100D shown in FIG. 10(*b*). In the cash handling system 10D of this embodiment, the position of the conveyance branch path 120*a* is arbitrarily changeable in the certain range in the upper unit 100D. The position of the upper unit 100D relative to the lower unit 200 is thus changeable arbitrarily in some extent.

The structure of the fifth embodiment does not require the multiple branch paths of the conveyor line 120 or the conveyor line 220 or the multiple elements of the conveyance route selector 140, unlike the cash handling systems of the first through the fourth embodiments described above. This desirably simplifies the structure of the cash handling system, while reducing the total number of parts and thereby reducing the manufacturing cost of the cash handling system.

F. Variations

The present invention is not limited to the embodiments and aspects described above. The present invention may be worked in various aspects within limits that involve no departure from the spirit of the invention; for example, the following variations are possible.

F1. Variation 1

The cash handling systems of the first through the fourth embodiments described above have either the multiple first bill transfer openings 160 or the multiple second bill transfer openings 210. The multiple first or second bill transfer openings are, however, not essential. The cash handling system may have only one first bill transfer opening and only one second bill transfer opening. For example, in the branched structure of the conveyor line 120 to the multiple conveyance branch paths 120*a* to 120*c* as in the first embodiment, one first bill transfer opening 160 is formed to have a large opening area, in order to ensure transfer of bills through any of the conveyance branch paths 120*a* to 120*c* to the first bill transfer opening 160. In this modified structure, the position of the upper unit 100 relative to the lower position is changeable by adjusting the position of one of the conveyance branch paths 120*a* to 120*c* to be aligned with the position of the conveyor line 220.

F2. Variation 2

In the cash handling systems of the first through the fourth embodiments described above, the three first bill transfer openings 160*a* to 160*c* or the three second bill transfer openings 210*a* to 210*c* are arrayed in the front-back direction. This arrangement is, however, neither restrictive nor essential. The multiple first bill transfer openings 160 or the multiple second bill transfer openings 210 may be arrayed in a left-right direction seen from the user. In the cash handling system 10 of the first embodiment, the conveyance branch paths 120*a* to 120*c* may be branched off in the left-right direction from the conveyor line 120 corresponding to the left-right array of the three first bill transfer openings 160*a* to 160*c*. This structure enables the position of the upper unit 100 to be changed relative to the lower unit 200 in the left-right direction.

F3. Variation 3

In the cash handling system 10B of the third embodiment, the unit position detector 180 includes the light emitting elements 180*a* to 180*c* located in the upper unit 100B and the light receiving element 180*d* in the lower unit. The unit position detector 180 is, however, not restricted to this structure but may have a modified structure as explained below.

Figure 11:
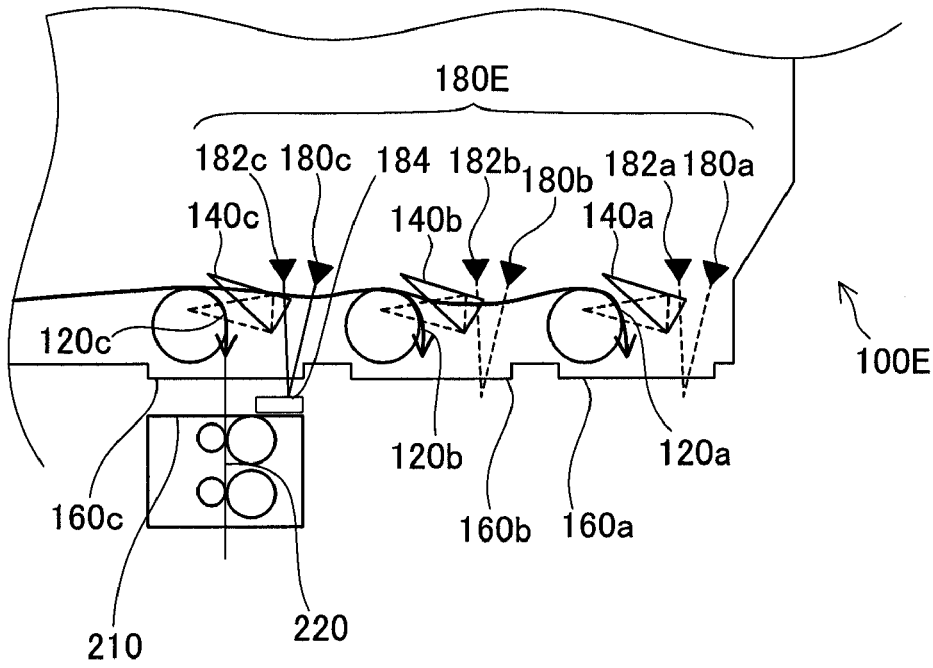
FIG. 11 shows one modified structure of the unit position detector 180 in Modified Example 1 of the third embodiment.

(1) FIG. 11 shows one modified structure of the unit position detector 180 in Modified Example 1 of the third embodiment. A unit position detector 180E includes light emitting elements 180*a* to 180*c*, light receiving elements 182*a* to 182*c*, and a reflecting mirror 184. As illustrated, the light emitting elements 180*a* to 180*c* and the light receiving elements 182*a* to 182*c* are provided corresponding to the first bill transfer openings 160*a* to 160*c* in an upper unit 100E. The reflecting mirror 184 is provided in the vicinity of the second bill transfer opening 210 in a lower unit.

In the illustrated state, the upper unit 100E is mounted on the lower unit in such a manner that the first bill transfer opening 160*c* is aligned with the second bill transfer opening 210. In this state, light emitted from the light emitting element 180*c* is reflected by the reflecting mirror 184 and is received by the light receiving element 182*c*. This proves the positional alignment of the first bill transfer opening 160*c* with the second bill transfer opening 210. This modified structure in Modified Example 1 accordingly has the same advantages and effects as those of the structure of the third embodiment.

Figure 12:
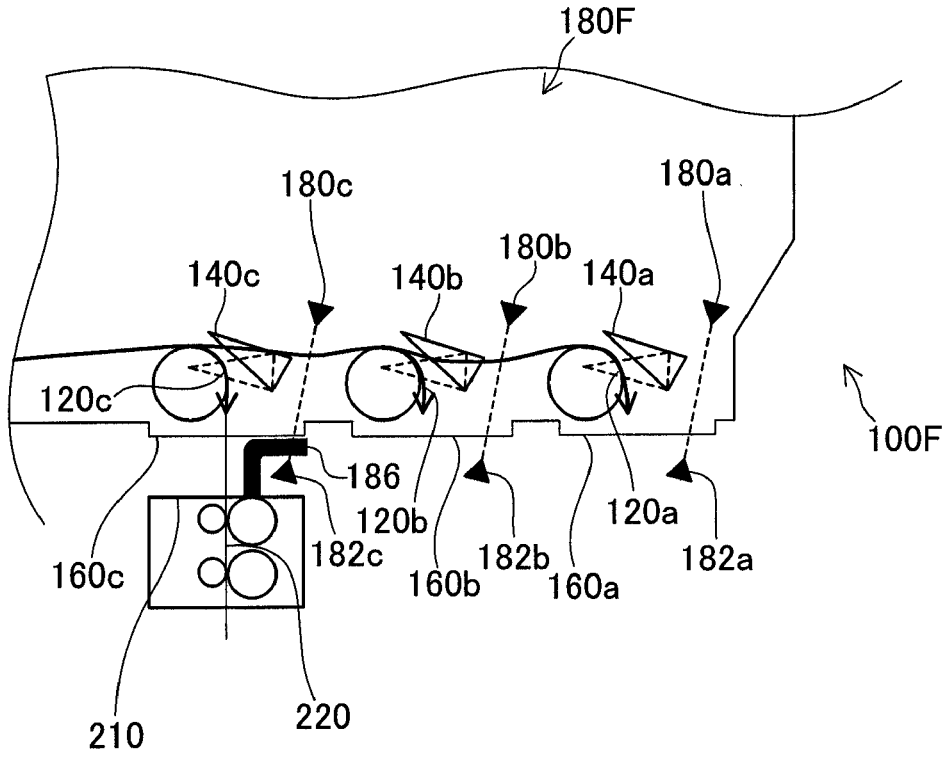
FIG. 12 shows another modified structure of the unit position detector 180 in Modified Example 2 of the third embodiment.
Figure 13:
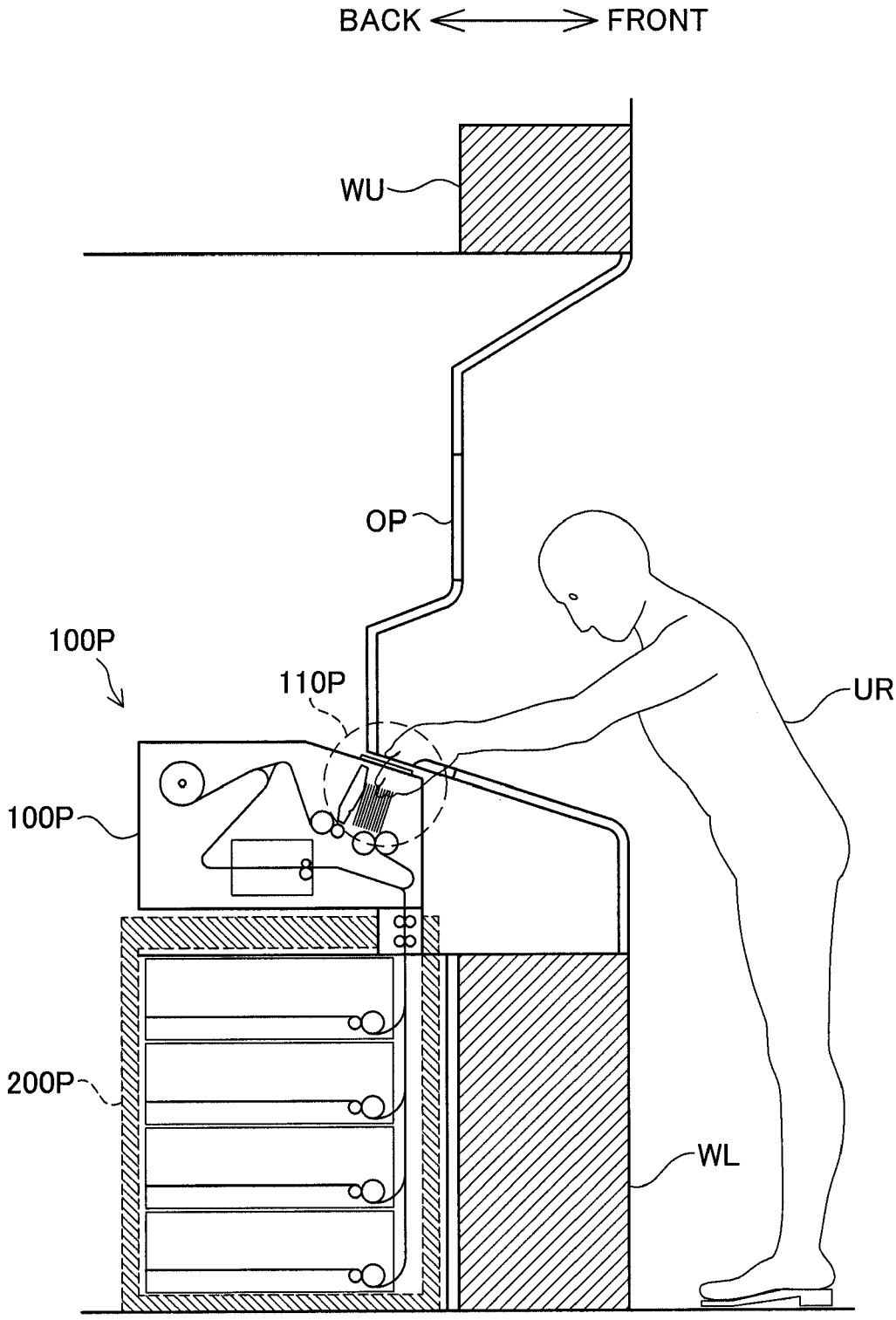
FIG. 13 shows a prior art structure of an ATM in outside wall installation.

(2) FIG. 12 shows another modified structure of the unit position detector 180 in Modified Example 2 of the third embodiment. A unit position detector 180F includes light emitting elements 180*a* to 180*c*, light receiving elements 182*a* to 182*c*, and a light shield element 186. As illustrated, the light emitting elements 180*a* to 180*c* and the light receiving elements 182*a* to 182*c* are provided corresponding to the first bill transfer openings 160*a* to 160*c* in an upper unit 100F. The light shield element 186 is provided in the vicinity of the second bill transfer opening 210 in a lower unit.

In the illustrated state, the upper unit 100F is mounted on the lower unit in such a manner that the first bill transfer opening 160*c* is aligned with the second bill transfer opening 210. In this state, light emitted from the light emitting element 180*c* is shielded by the light shield element 186, so that the light receiving element 182*c* does not receive the light emitted from the light emitting element 180*c*. No reception of light emitted from the light emitting element 180*c* by the light receiving element 182*c* proves the positional alignment of the first bill transfer opening 160*c* with the second bill transfer opening 210. This modified structure in Modified Example 2 accordingly has the same advantages and effects as those of the structure of the third embodiment.

(3) The unit position detector is not restricted to the optical sensor as in the third embodiment and its modified examples. Any of other diverse techniques may be adopted to detect the position of the upper unit relative to the lower unit. One available technique measures the distance between the front face of the upper unit and the front face of the lower unit.

F4. Variation 4

In the cash handling systems of the respective embodiments described above, the conveyor belts are used for conveyance of bills. The conveyance belts are, however, not essential. A modified structure may not use any conveyor belts but utilize the combination of conveyor rollers and plastic guides. The combination of conveyor rollers and plastic guides also enables conveyance of bills.

What is claimed is:

1. A cash handling system having an first unit mounted on a second unit, the first unit comprising:

a cash slot arranged to deposit a bill into the cash handling system and to withdraw a bill from the cash handling system;

a first bill transfer opening provided on a second-unit-opposing face of the first unit and configured to transfer the bill from and to the second unit; and a first conveyor line arranged to convey the bill between the cash slot and the first bill transfer opening, the second unit comprising:

a second bill transfer opening provided on a first-unit-opposing face of the second unit and configured to transfer the bill from and to the first unit;

a cash cartridge configured to keep the bill deposited or to be withdrawn via the cash slot of the first unit; and a second conveyor line arranged to convey the bill between the second bill transfer opening and the cash cartridge, wherein, regarding a number of transfer openings, one of: the first bill transfer opening and the second bill transfer opening, is provided with at least first and second alternate bill transfer openings provided at differing respective locations and selectable to transfer the bill to the other one of the first bill transfer opening and the second bill transfer opening;

wherein the first unit and the second unit are selectably positionable at a first position relative to each other to have the first alternate bill transfer opening selected to transfer the bill between the first and second units, and selectably positionable at a second position relative to each other to have the second alternate bill transfer opening selected to transfer the bill between the first and second units, the cash handling system further comprising: a moving mechanism configured to move the first unit or the second unit, along the opposed face of the first unit or the second unit.

2. The cash handling system in accordance with claim 1, wherein at least one of the first unit and the second unit further comprises:

a bill sensor configured to detect presence of the bill conveyed to the first bill transfer opening or the second bill transfer opening.

3. The cash handling system in accordance with claim 1, wherein the cash handling system further comprises:

a unit position detector configured to detect confirmed alignment of the first unit and the second unit at the first and/or second position relative to each other.

4. The cash handling system in accordance with claim 1, wherein either the first bill transfer opening or the second bill transfer opening comprises:

a bill transfer interference mechanism configured: to interfere with transfer of the bill using the second alternate bill transfer opening when the first and second units are selectably positionable at the first position relative to each other to have the first alternate bill transfer opening selected to transfer the bill between the first and second units, and to interfere with transfer of the bill using the first alternate bill transfer opening when the first and second units are selectably positionable at the second position relative to each other to have the second alternate bill transfer opening selected to transfer the bill between the first and second units.

* * * * *